United States Patent [19]

Makishima et al.

[11] Patent Number: 4,853,274

[45] Date of Patent: Aug. 1, 1989

[54] THERMAL TRANSFER MATERIAL

[75] Inventors: Hideo Makishima; Kenji Hyodo, both of Tokyo, Japan

[73] Assignee: Mitsubishi Paper Mills, Ltd., Tokyo, Japan

[21] Appl. No.: 166,516

[22] Filed: Mar. 10, 1988

[30] Foreign Application Priority Data

Mar. 12, 1987 [JP] Japan ..... 62-57831

[51] Int. Cl.[4] ..... B41M 5/26

[52] U.S. Cl. ..... 428/143; 428/141; 428/195; 428/323; 428/409; 428/484; 428/488.4; 428/913; 428/914

[58] Field of Search ..... 428/488.4, 195, 207, 428/204, 206, 208, 484, 488.1, 913, 914, 141, 143, 323, 409

[56] References Cited

U.S. PATENT DOCUMENTS 4,675,233 6/1987 Nakahara et al. ..... 428/480

FOREIGN PATENT DOCUMENTS 138483 4/1985 European Pat. Off. ..... 428/195

*Primary Examiner*—Ellis P. Robinson
*Assistant Examiner*—P. R. Schwartz
*Attorney, Agent, or Firm*—Cushman, Darby & Cushman

[57] ABSTRACT

A thermal transfer material having a heat resistant layer on a base film, said heat resistant layer having an average surface roughness of 0.15 to 0.35 μm and projections of 0.35 to 1.00 μm high in number of 50 or more per $mm^2$ on the surface thereof, is excellent in image quality and stability thereof without causing sticking to a thermal head.

2 Claims, No Drawings

THERMAL TRANSFER MATERIAL

BACKGROUND OF THE INVENTION

This invention relates to a thermal transfer material which is used in thermal printing equipments such as thermal printers, etc.

More particularly, it relates to a thermal transfer material which permits formation of an image on an image-receiving sheet in a thermal printing equipment in which thermal printing corresponding to image information is conducted by means of a thermal head or the like.

Recently, thermal transfer materials comprising a substrate and a hot-melt ink (hereinafter referred to as "thermal transfer ink") coated thereon have rapidly come to be used in thermal printing equipments such as thermal printers, thermal facsimiles, etc., so that clear images can be formed on ordinary paper.

As the substrate, there is used a plastic film such as a polyethylene terephthalate (PET) film of about 4 to about 6μ in thickness, whose surface to be brought into contact with a thermal head has a heat resistant layer for preventing sticking.

As to the heat resistant layer, there are various prior art references.

For example, in Japanese Patent Application Kokai (Laid-Open) No. 56-155794, it is proposed that a sticking-preventing layer (a kind of heat resistant layer) comprising an inorganic pigment having a high lubricity and a resin material which is thermosetting or has a high plasticity or a high softening point should be formed on one side of a plastic film. As the inorganic pigment, there are exemplified, for example, particles having a particle size of about 0.01 to about 5 μm of talc, mica powder, fine silica powder, molybdenum disulfide, etc. As the resin material, there are exemplified silicone resins, epoxy resins, melamine resins, phenolic resins, fluorine-contained resins, polyimide resins, nitrocellulose resins, etc. The ratio of the resin material to the inorganic pigment is about 20: about 80 to about 98: about 2 by weight. The thermal transfer material proposed permits prevention of sticking phenomenon but has the following defects. The surface roughness of the heat resistant layer is too high, so that its heat conduction becomes insufficient, resulting in a very serious adverse effect on the quality of printing. That is to say, there are non-transferred portions in one image plane, or when the same pattern is printed in many copies, the quality of printing is very uneven. Therefore, said thermal transfer material is insufficient to the attainment of a high quality of printing. Particularly in the case of color thermal transfer materials, only one of three colors, yellow, magenta and cyan changes in hue owing to unsatisfactory transfer in some cases. When the particle size of the inorganic particles exceeds 0.35 μm, the image quality is deteriorated, while it is less than 0.15 μm, sticking tends to occur.

On the other hand, U.S.P. 4,675,233 discloses a transfer material for printer using as a base a biaxially oriented polyester film having on at least one side thereof a rough surface having an average centerline roughness of 0.02 to 1 μm and a maximum height of 0.2 to 10 μm. However, this transfer material is poor in stability of image quality and can cause sticking. There has been reported no technical idea that in order to remove these defects, a heat resistant layer is formed on one side of a base film so as to have projections of 0.35 to 1.00 μm high in number of 50 or more per $mm^2$ on the surface thereof.

SUMMARY OF THE INVENTION

This invention is intended to provide a thermal transfer material which is excellent not only in stability of the quality of transferred image without deterioration thereof but also in resistance to sticking.

This invention provides a thermal transfer material comprising a base film, a hot-melt ink layer formed on one side of the base film and a heat resistant layer formed on another side of the base film, said heat resistant layer containing organic and/or inorganic particles having an average particle size of 0.2 to 0.4 μm, and said heat resistant layer having an average surface roughness of 0.15 to 0.35 μm and projections of 0.35 to 1.00 μm high in number of 50 or more per $mm^2$ on the surface thereof.

DESCRIPTION OF THE PREFERRED EMBODIMENTS

As the base film in the thermal transfer material of this invention, there can be used conventional films, for example, films of polyester resins such as polyethylene terephthalate and the like; polyamide resins such as nylons and the like; polycarbonates; and polyolefins such as polypropylenes and the like. Among them, a film of polyethylene terephthalate of about 4 to about 6 μm in thickness which is thick and has a high strength is preferred. The base film may contain inorganic particles having a particle size of preferably 0.04 to 2.0 μm for easy lubrication.

Inorganic particles may be incorporated into the base film in order that the average surface roughness of the heat resistant layer may be 0.15 to 0.35 μm and that projections of 0.35 to 1.00 μm high may exist in number of 50 or more per $mm^2$ on the surface of the heat resistant layer. As the inorganic particles, there can be used, for example, silica, alumina, titanium microfine particles, calcium carbonate, etc. The particle size is preferably 0.04 to 2.0 μm. The definition and measurement of the average roughness are in accordance with JIS B0601.

The adding amount of the inorganic particles is preferably 1 to 6% by weight based on the polymer and is determined so as to attain a desired surface roughness.

The heat resistant layer comprises a resin or a vitreous material and organic or inorganic particles.

The resin or vitreous material includes, for example, silicone resins, silicone copolymers, melamine resins, urethane resins, alkyd resins, acrylic resins, polyfunctional acrylic resins, silicone functional resins, silyl isocyanate, polyimide resins, cured products of alkoxysilane hydrolyzates, and mixtures thereof.

As the organic or inorganic particles, there may be exemplified, for example, particles having an average particle size of about 0.2 to about 0.4 μm of fluorine-contained resins, guanamine resins, silica, talc, etc.

The ratio of the resin or vitreous material to the organic or inorganic particles is preferably 100:5 to 100:0.3 by weight, more preferably 100:less than 2-0.3 by weight from the viewpoint of the average roughness. It is preferably 100:5 to 100:0.05 by weight when inorganic particles are contained in the base film.

The coating amount of the heat resistant layer is preferably 0.1 to 0.3 $g/m^2$ because at such an amount, the heat conduction of the resulting thermal transfer material is not inhibited.

A small amount of an antistatic agent may be incorporated into the heat resistant layer.

The average surface roughness of the heat resistant layer should be 0.15 to 0.35 μm. When it is more than 0.35 μm, the adherence of a thermal head and the surface of the heat resistant layer is insufficient and the heat conductivity is low. Therefore, the reproducibility of the form of the thermal head is low, so that a part of image drops out or become blurred, resulting in deterioration of the quality of printing.

When the average surface roughness of the heat resistant layer is less than 0.15 μm, the adherence of a thermal head and the surface of the heat resistant layer is excessive, so that sticking phenomenon tends to occur.

The sticking is a phenomenon that a thermal head is fused together with the heat resistant layer at the time of heating, resulting in unsatisfactory running of the thermal transfer material or in unsatisfactory transfer.

Even when the average surface roughness of the heat resistant layer is 0.15 to 0.35 μm, the sticking phenomenon tends to occur in the case where the number of projections of 0.35 to 1.00 μm high on the surface of the heat resistant layer is less than 50 per $mm^2$. That is to say, projections of 0.35 to 1.00 μm high should exist in number of 50 or more per $mm^2$ on the surface of the heat resistant layer. Needless to say, the average roughness and projections of the surface of the heat resistant layer are affected by the average roughness and projections of the film base.

Each hot-melt ink used in this invention comprises a coloring agent, a solid wax and a resin.

As the coloring agent, for example, the following can be used. As yellow coloring agent, there can be used Chromophthal Yellow 3G, Hansa Yellow G, Hansa Yellow 5G, Hansa Yellow RN, Hansa Yellow A, Hansa Yellow R, Lionol Yellow K-2R, Benzidine Yellow G, Benzidine Yellow GR, Quinoline Yellow Lake, etc.

As magenta coloring agents, there can be used Rhodamine Lake Y, Brilliant Carmine 6B, Brilliant Carmine BS, Permanent Carmine FB, Hosta Palm Pink, Brilliant Fast Scarlet, Permanent Red F5R, etc.

As cyan coloring agents, there can be used Phthalocyanine Blue, Lionol Blue, Victoria Blue Lake, Fast Sky Blue, etc.

As black coloring agents, there can be used carbon black, graphite, iron black, Aniline Black, etc.

As the solid wax, there can be used petroleum waxes such as paraffin wax, microcrystalline wax, etc.; vegetable waxes such as carnauba wax, candelilla wax, rice wax, etc.; synthetic waxes such as low-molecular-weight polyethylene wax, Montan wax, Fischer-Tropsch wax, etc.; oxidized waxes such as oxidized paraffin wax, oxidized polyethylene wax, etc.

It is preferable to use a solid wax having a melting point of 50° C. or higher (a peak temperature value measured by a differential scanning calorimeter (DSC)), more preferably 50° to 80° C, most preferably 65° to 75° C.

As the resin, there can be used thermoplastic resins such as ethylene-vinyl acetate copolymer, ethylene-ethyl acrylate copolymer, polyamide resins, rosin and rosin derivatives, terpene resins, petroleum resins, coumarone-indene resin, etc.

If necessary, the hot-melt ink layer can be incorporated with antistatic agents, dispersants, etc. as additives, in addition to the components described above.

According to this invention, the heat resistant layer has an average surface roughness of 0.15 to 0.35 μm and projections of 0.35 to 1.00 μm high in number of 50 or more per $mm^2$ on the surface thereof, and therefore a thermal transfer material excellent in resistance to sticking can be provided without deterioration of the quality of transferred image.

When the surface roughness is as described above, heat from a thermal head is efficiently conducted to an ink film and the printing properties are excellent. Furthermore, the balance between adherence and peeling-off of the thermal head and the ink film is favorable, so that not only the sticking resistance but also the running properties are excellent.

This invention is illustrated below by way of the following Examples, in which all parts and percents are by weight unless otherwise specified.

EXAMPLE 1

A coating composition for heat resistant layer was prepared by mixing 100 parts (in terms of solids) of acryl-modified silicone (KR-9706, a trade name, mfd. by Shinetsu Silicone Co., Ltd.) with 0.5 part of fluorine-contained resin powder having an average particle size of 0.3 μm (Surflon SR-100X, a trade name). A heat resistant layer of 0.2 $g/m^2$ was formed on one side of a PET film of 6μ in thickness by solvent coating of the coating composition.

A black thermal transfer ink having a melting point of 70° C. was coated on the other side of the PET film in an amount of 3.5 $g/m^2$ to obtain a thermal transfer material of this invention. The average surface roughness of the heat resistant layer was 0.22 μm and the number of projections of 0.35 to 1.00 μm high on the surface was 80 per $mm^2$.

When the thermal transfer material obtained was subjected to printing by means of a telecopier manufactured by Xerox Corp., excellent transferred images were obtained, no sticking occurred, and the running properties were excellent.

COMPARATIVE EXAMPLE 1

A coating compositions for heat resistant layer was prepared by mixing 100 parts (in terms of solids) of acryl-modified silicone (KR-9706, a trade name, mfd. by Shin-etsu Silicone Co., Ltd.) with 0.1 part of fluorine-contained resin powder having an average particle size of 0.2 μm (Surflon SR-100X, a trade name). A heat resistant layer of 0.2 $g/m^2$ was formed on one side of a PET film of 6μ in thickness by solvent coating of the coating composition.

A black thermal transfer ink having a melting point of 70° C. was coated on the other side of the PET film in an amount of 3.5 $g/m^2$ to obtain a thermal transfer material other than that of this invention. The average surface roughness of the heat resistant layer was 0.12 μm and the number of projections of 0.35 to 1.00 μm high on the surface was 30 per $mm^2$.

When the thermal transfer material obtained was subjected to printing by means of a telecopier manufactured by Xerox Corp., sticking occurred.

COMPARATIVE EXAMPLE 2

A coating composition for heat resistant layer was prepared by mixing 100 parts (in terms of solids) of acryl-modified silicone (KR-9706, a trade name, mfd. by Shin-etsu Silicone Co., Ltd.) with 0.4 part of fluorine-contained resin powder having an average particle size of 0.2 μm (surflon SR-100X, a trade name). A heat resistant layer of 0.2 g/m² was formed on one side of a PET film of 6μ in thickness by solvent coating of the coating composition.

A black thermal transfer ink having a melting point of 70° C. was coated on the other side of the PET film in an amount of 3.5 g/m² to obtain a thermal transfer material other than that of this invention. The average surface roughness of the heat resistant layer was 0.17 μm and the number of projections of 0.35 to 1.00 μm high on the surface was 40 per mm².

When the thermal transfer material obtained was subjected to printing by means of a telecopier manufactured by Xerox Corp. sticking occurred. EXAMPLE 2

A coating composition for heat resistant layer was prepared by mixing 100 parts (in terms of solids) of acryl-modified silicone (KR-9706, a trade name, mfd. by Shin-etsu Silicone Co., Ltd.) with 0.35 part of fluorine contained resin powder having an average particle size of 0.3 μm (Surflon SR-100X, a trade name). A heat resistant layer of 0.2 g/m² was formed on one side of a PET film of 6 μm in thickness by solvent coating of the coating composition. A black thermal transfer ink having a melting point of 70° C. was coated on the other side of the PET film in an amount of 3.5 g/m² to obtain a thermal transfer material of this invention.

The average surface roughness of the heat resistant layer was 0.17 μm and the number of projections of 0.35 to 1.00 μm high on the surface was 60 per mm².

When the thermal transfer material obtained was subjected to printing by means of a telecopier manufactured by Xerox Corp., excellent transferred images were obtained, no sticking occurred, and the running properties were excellent.

COMPARATIVE EXAMPLE 3

A coating composition for heat resistant layer was prepared by mixing 100 parts (in terms of solids) of acryl-modified silicone (KR-9706, a trade name, mfd. by Shin-etsu Silicone Co., Ltd.) with 10 parts of fluorine contained resin powder having an average particle size of 0.3 μm (Surflon SR-100X, a trade name). A heat resistant layer of 0.2 g/m² was formed on one side of a PET film of 6 μm in thickness by solvent coating of the coating composition.

A black thermal transfer ink having a melting point of 70° C. was coated on the other side of the PET film in an amount of 3.5 g/m² to obtain a thermal transfer material other than that of this invention.

The average surface roughness of the heat resistant layer was 0.38 μm and the number of projections of 0.35 to 1.00 μm high on the surface was 100 or more per mm².

When the thermal transfer material obtained was subjected to printing by means of a telecopier manufactured by Xerox Corp., the transferability was insufficient and a part of image dropped out or became blurred.

EXAMPLE 3

To polyethylene terephthalate was added 3% of silica having a particle size of 0.1 μm, and a PET film of 6μ in thickness was formed of the resulting mixture.

A coating composition for heat resistant layer was prepared by mixing 100 parts (in terms of solids) of acryl-modified silicone (KR-9706, a trade name, mfd. by Shin-etsu Silicone Co., Ltd.) with 0.1 part of fluorine-contained resin powder having an average particle size of 0.2 μm (Surflon SR-100X, a trade name). A heat resistant layer of 0.2 g/m² was formed on one side of the PET film of 6 μm in thickness containing silica as an internal additive, by solvent coating of the coating composition.

A black thermal transfer ink having a melting point of 70° C. was coated on the other side of the PET film in an amount of 3.5 g/m² to obtain a thermal transfer material of this invention. The average surface roughness of the heat resistant layer was 0.22 μm and the number of projections of 0.35 to 1.00 μm high on the surface was 100 or more per mm².

When the thermal transfer material obtained was subjected to printing by means of a telecopier manufactured by Xerox Corp., excellent transferred images were obtained, no sticking occurred, and the running properties were excellent.

As described above, this invention is free from the sticking phenomenon, which has heretofore been a problem in thermal transfer materials, without deterioration of image quality. Therefore, the practical value of this invention is very high in these days of rapid spread of thermal transfer printers.

What is claimed is:

1. A thermal transfer material comprising a polymeric base film, a hot-melt ink layer formed on one side of the base film, said hot-melt ink layer comprising a coloring agent, a solid wax and a resin, and a heat resistant layer formed on the other side of the base film, said heat resistant layer comprising a resin and particles having an average particle size of 0.2 to 0.4 μm, and said heat resistant layer having an average surface roughness of 0.15 to 0.35 μm, and projections of 0.35 to 1.00 μm high, there being 50 or more of said projections per mm² on the surface thereof, the amount of particles in the heat resistant layer being from 0.05 to 5 parts by weight per 100 parts by weight of the solid content of the heat resistant layer; said base film containing inorganic particles in an amount ranging from 1 to 6 parts by weight per 100 parts by weight of the polymer of the base film and having an average particle size of 0.04 to 2.0 μm.

2. A thermal transfer material according to claim 1, wherein the amount of the particles is 0.3 part by weight or more and less than 2 parts by weight per 100 parts by weight of the solid content of the heat resistant layer except for the particles.

* * * * *